US005195743A

United States Patent [19]

Walsh, Jr.

[11] Patent Number: 5,195,743

[45] Date of Patent: Mar. 23, 1993

[54] GOLF CLUB CLEANER AND TEE

[76] Inventor: Thomas J. Walsh, Jr., 2 Deer Run Rd., Poughkeepsie, N.Y. 12603

[21] Appl. No.: 774,212

[22] Filed: Oct. 10, 1991

[51] Int. Cl.[5] ..... A63B 57/00

[52] U.S. Cl. ..... 273/32 B; 273/32 A; 273/33; 273/212; 15/105; 15/236.01

[58] Field of Search ..... 273/32 A, 33, 32 B, 273/32 R, 212, 183 A; 15/105, 236.01

[56] References Cited

U.S. PATENT DOCUMENTS

| | | | |
|---|---|---|---|
| 2,107,944 | 2/1938 | Howard | 273/32 A |
| 3,782,723 | 1/1974 | Morris | 273/33 |
| 4,516,773 | 5/1985 | Martin | 273/32 A |
| 4,951,945 | 8/1990 | Gamble | 273/33 |
| 5,007,129 | 4/1991 | Hainey | 273/32 B X |

FOREIGN PATENT DOCUMENTS

| | | | |
|---|---|---|---|
| 2202752 | 10/1988 | United Kingdom | 273/32 A |

*Primary Examiner*—George J. Marlo
*Attorney, Agent, or Firm*—Joseph B. Taphorn

[57] ABSTRACT

Conventional golf tees and markers are modified to provide golf club face and club face groove cleaners. The heads of tees and markers are formed square rather than round to provide straight edges for scraping the faces of dirtied golf clubs and with the edges intersecting to form sharp corners for insertion in club face grooves to facilitate eviction of the dirt therein. The stems of tees may be made of wood and the heads thereof of a molded material to provide superior cleaning capability.

2 Claims, 3 Drawing Sheets

GOLF CLUB CLEANER AND TEE

INTRODUCTION

1. Field of the Invention

This invention relates to golf club cleaners, and more particularly, to common golf devices modified to clean the faces and grooves on the faces of golf clubs.

2. Prior Art

Golf, as is well known, is a game (round) played on a course having eighteen holes in as many greens, the object being to propel a small ball using a succession of clubs having grooves on their faces, into each hole with as few strokes (shots) as possible. On the initial stroke of each hole the ball is teed up above the ground level for better striking by a club. For subsequent shots on a hole, the ball is usually lying on the ground, and a divot (piece of turf torn up by a golf club in striking the ball) is usually taken. Sometimes a divot is even taken when striking the ball off the tee. In either event, the face of the club becomes dirty on taking of a divot. The grooves on the face of the club become filled with dirt or debris, impairing the ability of the grooves to perform their function (control the spin of the ball). Cleaning the grooves of clubs dirtied during a round is a continuing operation.

Golf tees and golf markers are carried by golfers playing a round of golf. A golf tee is a small peg with a concave round top or head for holding the golf ball for the initial stroke (drive). A golf marker is a round disc (head) with a depending pin. The marker is placed on a green with the pin inserted therein and the disc lying thereon for pointing out the place where a golf ball was lifted from the green to remove it from the possible path of another golf ball further from the hole. The ball may also be lifted for cleaning or other purposes.

SUMMARY OF THE INVENTION

Accordingly, it is an object of the invention to aid or abet the cleaning of dirtied golf clubs during a round of golf.

Another object of the invention is to facilitate the cleaning of golf clubs with objects normally carried by a golfer during a round and without special equipment.

A further object of the invention is to modify a golf tee to enable better cleaning of a club face with it.

Still another object of the invention is to modify a golf marker to enable better cleaning of a club face with it.

A still further object of the invention is to provide modified golf tees and markers which are facile in cleaning use.

An additional object of the invention is to provide modified golf tees and markers which continue to perform their present functions equally well and easily.

Yet another object of the invention is to provide modified golf tees and markers which remain simple of construction and easy of manufacture.

A yet further object of the invention is to provide dual purpose tees and markers suitable for a high production volumes.

Another additional object of the invention is to provide a modified tee that requires no extra material to manufacture.

The objects of the invention are accomplished by changing the shape of commonly carried golf objects. Thus the top or head of the golf tee is made square or other sharp cornered configuration rather than round, and the disc or head of a marker is made into a square. This provides straight edges on each of four sides of the tee and of the marker which will allow a relatively broad scraping action of the face of a dirtied club by either object. Four sides make for optimum conditions. However as stated above, any other sharp cornered configuration with linear edges and intersecting corners is likewise applicable. Moreover, pointed penetration can be obtained of the club face grooves by inserting the sharp corners formed by the intersecting straight edges of the objects in the grooves.

A feature of the invention is that square heads on the objects can be formed of plastic wherein the material is drawn to the corners to provide strong edges which allow the application of considerable force to the face and grooves of a club without destruction as when the dirt has dried on a club and hardened.

An obvious advantage of the invention is that it does not burden the golfer with additional objects in order to keep his clubs easily clean.

Another advantage of the invention is the provision of more space for advertising. The tops of markers are already frequently used to display advertising.

BRIEF DESCRIPTION OF THE DRAWINGS

These and other objects, features and advantages of the invention will become apparent from a reading of the following description of the preferred embodiments of the invention when considered with the appended drawings wherein.

DETAILED DESCRIPTION OF PREFERRED EMBODIMENTS OF THE INVENTION

Figure 1:
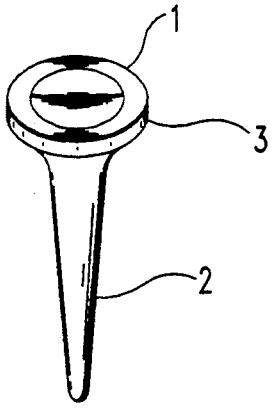
PRIOR ART FIG. 1
FIG. 1 is an isometric view showing a conventional golf tee with a round top.
Figure 2:
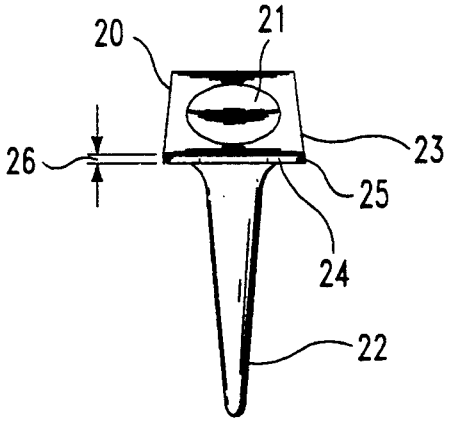
FIG. 2 is an isometric view showing a modified tee with a square top.
Figure 4:
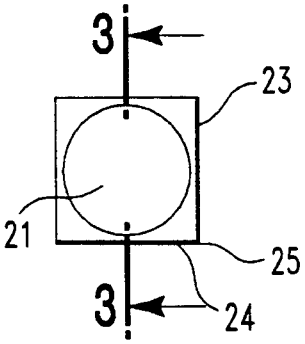
FIG. 4 is a top view of the tee of FIG. 2.
Figure 3:
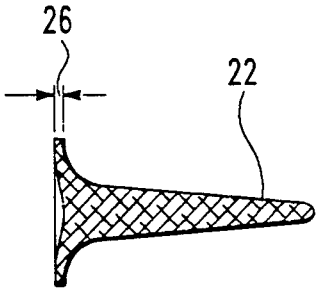
FIG. 3 is a sectional side view of the tee of FIG. 2 shown horizontally and as if taken along the section lines A—A of FIGS. 4 and 5.
Figure 5:
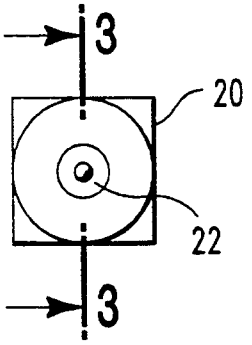
FIG. 5 is a bottom view of the tee of FIG. 2.

Referring now to the drawings, FIGS. 1–8 show the principles of the invention as applied to golf tees and FIGS. 9–13 show the principles as applied to golf markers. A conventional tee is shown in FIG. 1 and includes a round top or head 3 formed with a concave upper surface 1 to hold a golf ball (not shown) and with a gradually reduced radial body 2 to provide easy entry of the tee into the grassy or earthen ground.

Figure 15:
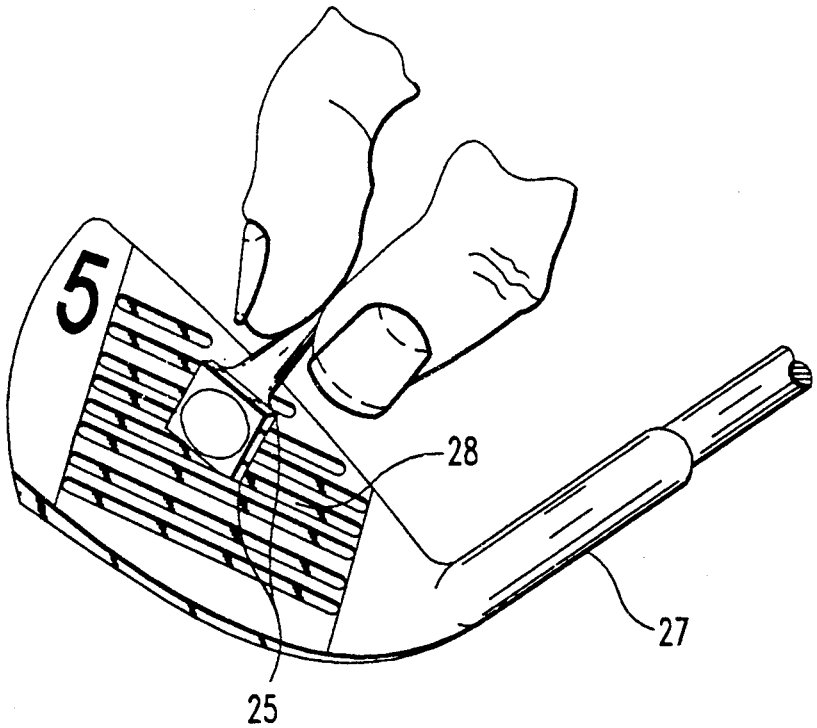
FIG. 15 is an isometric view of a typical golf club having its grooves cleaned by a pulling or pushing action on a tee.

One embodiment of a tee constructed according to the invention is shown in FIGS. 2-5. The tee has the same general shape as the conventional tee of FIG. 1 except for a square head 20. Thus it is formed with a concave upper surface 21 to hold a golf ball and with a gradually reduced radial body 22, of a length greater than the width of the head, to provide easy entry of the tee into the grassy or earthern ground. (Although the body 22 is shown round, it can readily be made of other geometric cross-section). The square head 20 has square edges such as 23 and 24, and these intersect as at 25 to define sharp corners which fit into golf club 27 grooves 28 of FIG. 15 and can be used to push or pull dirt out of them. The thickness of the head 20, as indicated at 26, can be varied with materials to provide the necessary strength. It likewise can be make to conform to any special form of groove.

Figure 14:
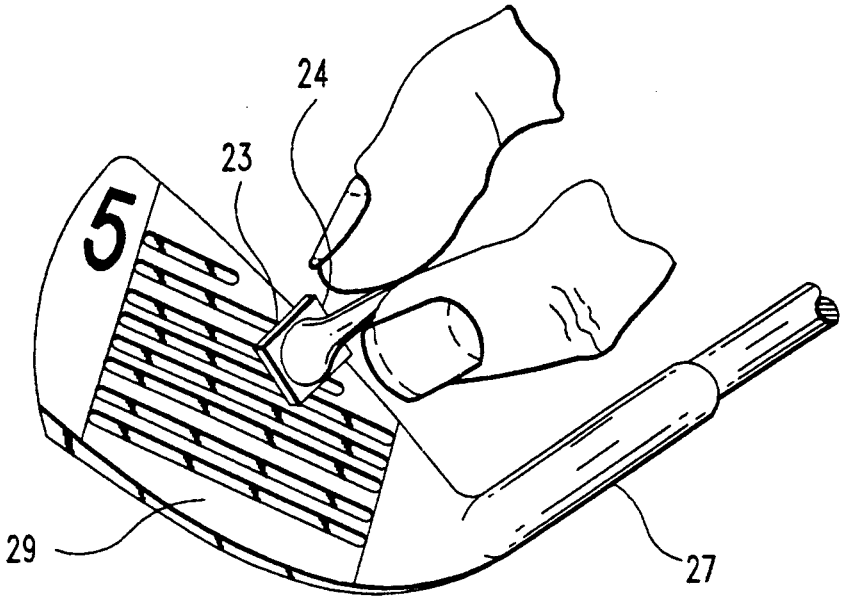
FIG. 14 is an isometric view of a typical golf club having its face scraped clean by a pulling or pushing action.

In use as a club face cleaner, the golfer would grasp the tee by the body 22 and apply one of the square head edges such as 23 or 24 to the face of a dirtied club face 29 of FIG. 14 to scrape it clean. To clean a dirtied groove, he would apply one of the square head corners such as 25 to the groove 28 of FIG. 15 and pull or push on the tee body 22 to force the dirt out of the groove. Of course, to perform its normal function, the tee would be grasped by its head 20 to push the body 22 into the earth.

It should be appreciated that in the manufacture of the all wood, square head tee, no additional wood is utilized over that utilized in manufacturing a conventional tee. In manufacturing conventional tees, the material of the head 3 corners is cut-away and wasted frcm square stock. Applicant's invention advantageously utilizes previously wasted material in that the square material about the head 20 is not cut away.

Figure 7:
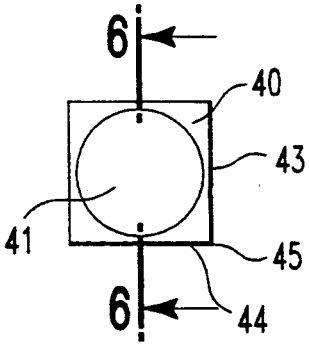
FIG. 7 is a top view of the tee of FIG. 6.
Figure 6:
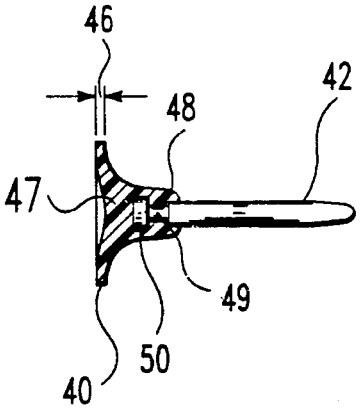
FIG. 6 is a sectional side view of a further modified tee, and as if taken along section lines B—B of FIGS. 7 and 8.
Figure 8:
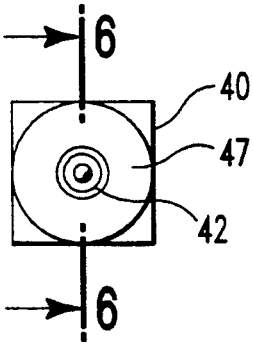
FIG. 8 is a bottom view of the tee of FIG. 6.

FIGS. 6-8 show a modified tee. As best seen in FIG. 6, the body 42 may be formed separately from the head 40. Thus the body 42 might be formed of the conventional wood or other desirable material, while the head could be of some other and tougher material such as polymers or composites. The head 40 would have the concave upper surface 41 for holding the golf ball, and the straight edges such as 43 and 45 for scraping the face of the golf club and the sharp corners such as 45 for placement in club face grooves to push or pull out any dirt therein.

To secure the head 40 to the body 42, the head 40 is formed with a hollow head 47 having an internal ring 48. The body 42 is formed with a necked-down portion 49 leaving a head 50. The two pieces may be assembled by forcing the body head 50 into the hollow head 47 and past the internal annular ring 48. Of course the head 40 could be directly molded onto the body 42. Undercutting, bonding or other known two shot locking geometries and/or materials may also be substituted.

It should be appreciated that in manufacturing the head 40, the molecules of the plastic material may be so oriented as to give additional toughness to the corners 45.

Figure 9:
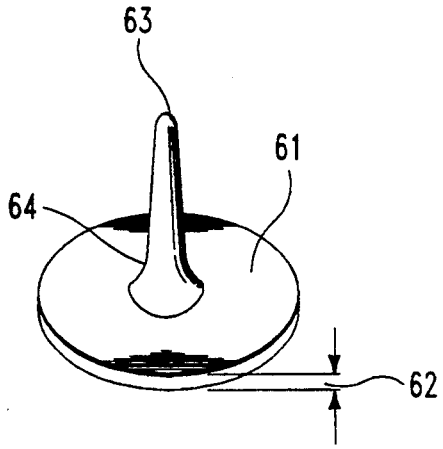
PRIOR ART FIG. 9
FIG. 9 is an isometric view showing a conventional golf ball marker with a round top or head.
Figure 10:
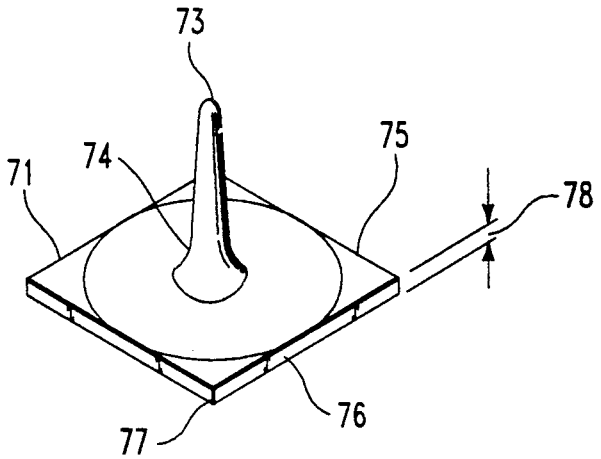
FIG. 10 is an isometric view showing the modified golf ball marker with a square top or head having straight edges intersecting to form sharp corners.
Figure 13:
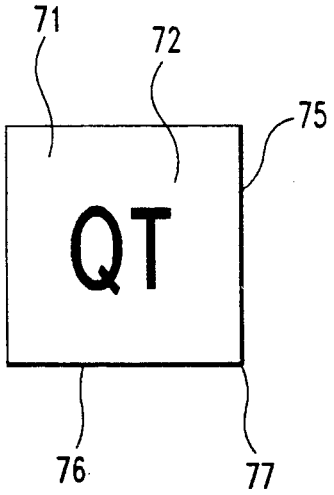
FIG. 13 is a top view of the marker of FIG. 11 and showing the enhanced advertising area.
Figure 11:
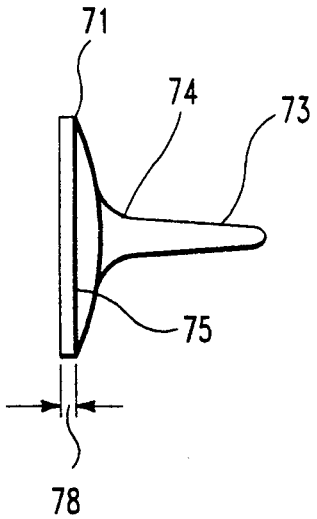
FIG. 11 is a side view of the marker of FIG. 10 shown horizontally
Figure 12:
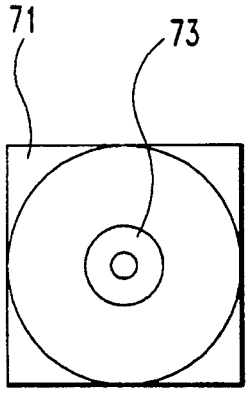
FIG. 12 is a bottom view of the marker of FIG. 11.

FIGS. 9-13 show golf ball markers. FIG. 9 shows inverted a conventional marker having a round flat top 61 of a thickness 62 and a stem 63 attached on the underside as at 64. The stem 63 is relatively thin and tapered to permit easy insertion into the earth.

FIGS. 10-13 show a marker modified according to the invention. A marker has a square flat top or head 71, and a relatively thin stem 73, of a length approximately equal to the width of the head, attached at its upper end to the underside of the top 71 at 74. Like the tees of FIGS. 2-8, the marker of FIGS. 10-13 features straight edges 75 and 76 for scraping club faces and for intersecting in sharp corners 77 for insertion of the corners into club face grooves for forcing dirt out of them, and a thickness at 78 or other conforming geometry to enable entry into the typical grooves of a golf club surface.

In using the marker as a golf club face cleaner, the golfer would grasp the marker by its depending stem 73 and/or upper portion of the head 71 and apply a straight edge such as 75 or 76 to the face of the club with a scraping motion. In using the marker as a groove cleaner, the golfer would grasp the marker by its depending stem and/or upper corner of the head and apply a sharp corner such as 77 to a groove and push or pull it therealong. In using the marker in its normal function, the marker would be grasped by the top 71 and the depending stem 73 pushed into the earth.

In manufacture, the tees and markers can be made using the same kind of equipment and the same kind of materials as currently used, enabling wide choices of woods, polymers, metals and composites.

The square construction of the heads and tops of the respective modified tees and markers provide additional upper surface areas. Advantageously, these surfaces may be used for advertising messages as for example the advertising message 72 of FIG. 13.

It will be appreciated that applicant has provided objects aiding or abetting the cleaning of golf clubs during a round of golf, that these objects are modified conventional objects already being carried by the golfer and not additional encumbrances, that the objects are facile in use and simple of construction and easy of manufacture and do not necessarily require additional materials. Further that the present uses of these objects are not impaired.

While applicant has shown preferred embodiments of the invention, it should be understood that other and different devices embodying principles of the invention will be apparent to those skilled in the art. It is therefore desired to be limited only by the scope or spirit of the appended claims.

What is claimed is:

1. A combined cleaning device and tee for supporting a golf ball comprising an elongated stem having a periphery, first and second ends, and a head at one end thereof, said head having an upper surface and a periphery extending laterally outward beyond the periphery of said stem, a depression in the upper surface of said head in which a golf ball may be supported, said periphery of said head having a predetermined thickness and including at least two linear peripheral edges which intersect each other to define a linear corner edge, said predetermined thickness being such that a substantial portion of the peripheral extent of said head is adapted to extend into the grooves in the striking face of a golf club and said linear corner edge is adapted to scrape dirt therefrom, said stem being adapted to support said head in a generally horizontal position with a golf ball located in said depression.

2. A dual-purpose golf object according to claim 1, wherein the length of the stem exceeds the weight of the head.

* * * * *